United States Patent [19]

Libit

[11] 4,402,435

[45] Sep. 6, 1983

[54] DISPENSING TYPE CAP CLOSURE

[76] Inventor: Sidney M. Libit, 141 Lakeside Ter., Glencoe, Ill. 60022

[21] Appl. No.: 264,129

[22] Filed: May 15, 1981

[51] Int. Cl.[3] ..... B65D 47/00; B67D 3/00

[52] U.S. Cl. ..... 222/556; 215/235; 220/335

[58] Field of Search ..... 220/335; 222/534–536, 222/556, 558, 498; 215/235

[56] References Cited

U.S. PATENT DOCUMENTS

| | | | |
|---|---|---|---|
| 1,300,528 | 4/1919 | Weeks | 220/335 |
| 1,687,482 | 10/1928 | Gillette | 220/335 |
| 1,843,559 | 2/1932 | Hornsey | 220/335 |
| 3,111,245 | 11/1963 | Libit et al. . | |
| 3,502,248 | 3/1970 | Libit et al. . | |
| 4,124,151 | 11/1978 | Hazard | 222/556 |
| 4,291,818 | 9/1981 | Nozawa et al. | 220/335 |

*Primary Examiner*—H. Grant Skaggs

*Attorney, Agent, or Firm*—Hill, Van Santen, Steadman & Simpson

[57] ABSTRACT

A relatively lightweight dispensing cap closure includes a base cap portion for attaching to a container opening and a closure portion mounted for pivotable movement in a depressed socket formed in a top surface of the cap. The top surface is formed with a dispensing orifice and the closure portion is formed with a stopper member which cooperates with the dispensing orifice to open and close the cap. The closure portion has a downturned rear flange portion which is received in the socket to permit the closure portion to lie in a substantially horizontal, closed condition with the stopper plugging the dispensing orifice and a substantially upright, opened condition whereby the closure portion is positioned out of the flow path through the dispensing orifice. The flange portion of the closure is formed with a restricted throat opening for receiving a relatively wider upright post member, in the socket, such that the closure portion is biased from a position approaching the vertical to a fully open position bent back from the vertical. A stop surface is provided to limit pivotal movement of the closure portion in the opened condition. The closure portion is provided with a leading lip surface which overhands the peripheral profile of the cap top in the closed condition to receive application of an upward force thereto for dislodging the stopper from the dispensing orifice and raising the closure portion to the opened condition. The lightweight construction of the inventive dispensing closure enables only a slight upward force to be necessary to raise the closure portion from its closed condition.

20 Claims, 5 Drawing Figures

FIG 1
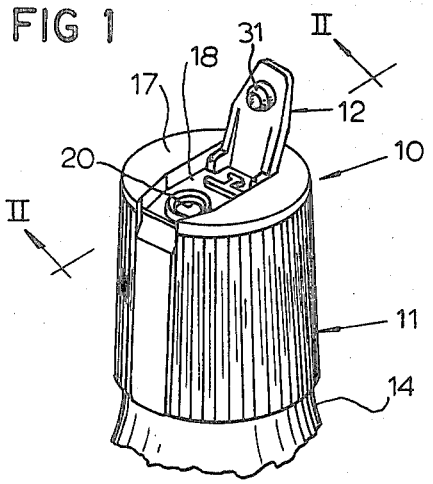
FIG 2
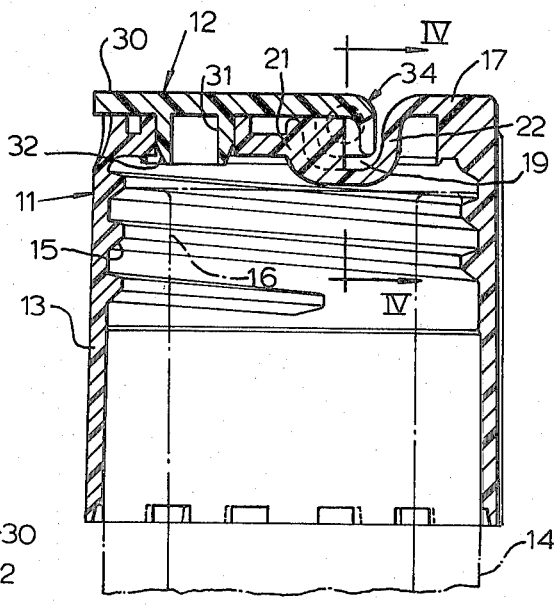
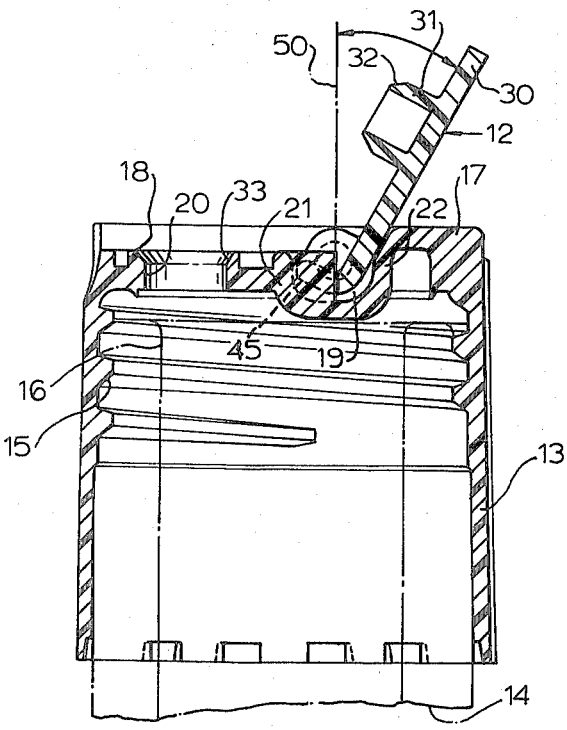
FIG 3
FIG 4
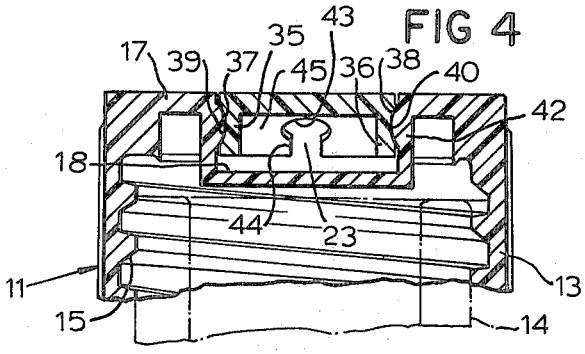
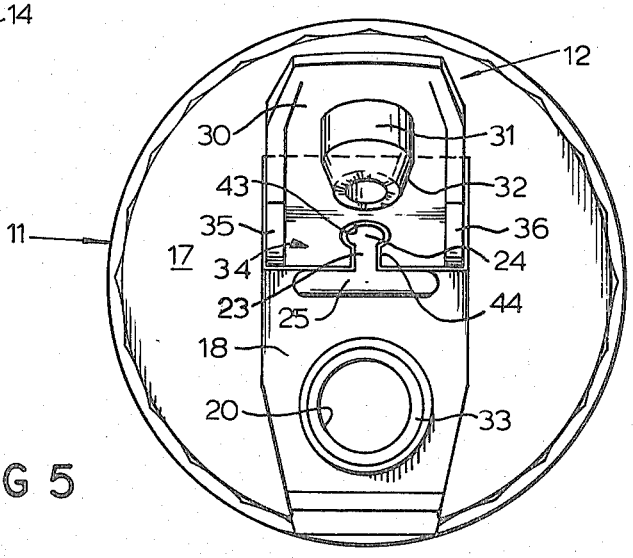
FIG 5

DISPENSING TYPE CAP CLOSURE

BACKGROUND OF THE INVENTION

1. Field of the Invention

The invention relates to a container cap having a pivotable dispensing closure portion and, more particularly, to a simplified and lightweight construction therefor.

2. The Prior Art

Dispensing closures of the type which includes a base cap portion for attaching to a container opening, such as a bottle mouth, and a closure member held in the cap for swiveling movement between closed and opened conditions are well-known in the art. U.S. Pat. No. 3,111,245 discloses one such swivelable dispensing closure. The closure portion is formed with a spout or nozzle part connected to a relatively large knuckle portion with a dispensing bore running longitudinally therethrough. The knuckle portion fits into a depressed socket formed on the cap base portion and is swivelable therein between a vertical opened condition, whereby the dispensing bore mates with a discharge opening formed in the bottom of the socket, and a generally horizontal closed condition, whereby the knuckle portion blocks the discharge opening. A further swivel spout dispensing closure construction is disclosed in U.S. Pat. No. 3,502,248. There, the closure member is similarly formed with a nozzle portion connected to a rounded knuckle portion which fits into a socket recess formed in the base cap portion for swivelable movement between a vertical opened condition and a generally horizontal closed condition. The knuckle portion is generally cylindrical and formed at opposed outer ends with lug-type members rotatably received in bearing openings formed in the sidewalls of the socket cavity.

One drawback with the prior art dispensing closures is that a large amount of material must be used in their construction. For this reason, the prior art dispensing closures tend to be of relatively heavy weight. Furthermore, the closure portions are relatively difficult to move between their opened and closed conditions. The present invention obviates these disadvantages by providing for a dispensing closure arrangement which is of relatively lightweight construction and, hence, more economical to produce and which is relatively easy to open and close.

SUMMARY OF THE INVENTION

A relatively lightweight dispensing closure comprises a cap base portion for sealably fitting over a container opening, such as a bottle mouth, and a closure portion which is pivotally mounted in a depressed socket formed in the top of the cap. A dispensing orifice extends through the cap top. The closure portion is formed with a stopper member dimensioned to be received in the dispensing orifice in substantially sealing relation when the closure portion is in a lowered or substantially horizontal closed condition. The closure portion is provided with a rearward downturned flange portion which is positioned within the socket. The flange has opposed side surfaces formed with recesses which cooperatively engage with projecting dimples formed on opposed sidewall portions of the socket, thus permitting snap receipt of the closure portion in the socket and pivotable rotation of the closure portion on the cap between its closed condition and a substantially upright opened condition, whereby the stopper is moved out of and away from the dispenser opening.

The stopper may be force fit into the dispensing orifice so as to provide a resilient force which enables the relatively lightweight closure portion to snap travel to its opened condition readily with application of only a slight upward force on the closure portion.

The flange is formed with a back wall containing an opening for passing about a raised post member located adjacent the forward end of the socket. The post contains a bulbous end portion and the opening has a throat portion relatively narrower than the width of the post bulb. When the closure portion is pivoted in its opened condition, the bulb is forced into the throat causing the flange portion to be thrust forwardly. This action pivots the closure portion fully backward from the initial opened condition until the flange back wall abuts against a planar surface formed on a socket front wall and the upper surface of the closure portion abuts against a slanted planar surface formed along the socket back wall. In this manner, the closure portion is held in a full open position spacing the stopper more than 90° away from the dispensing orifice such that discharge flow through the orifice is not obstructed. The pivotal movement of the closure portion is thus limited so that the closure portion cannot be snapped out of the socket by bending the closure portion too far back away from the dispensing orifice.

BRIEF DESCRIPTION OF THE DRAWINGS

FIG. 1 is a perspective elevational view of a lightweight dispensing cap closure constructed in accordance with the present invention.

FIG. 2 is a cross-sectional side elevational view taken along the lines II—II of FIG. 1 with the closure portion in the closed condition.

FIG. 3 is a cross-sectional side elevational view of the dispensing cap closure of FIG. 2 with the closure portion in the opened condition.

FIG. 4 is a fragmentary cross-sectional view taken along the lines IV—IV of FIG. 2

FIG. 5 is a top plan view of the dispensing cap closure shown in FIG. 1.

DESCRIPTION OF THE PREFERRED EMBODIMENTS

FIGS. 1–5 illustrate a dispensing cap closure 10 having a cup-shaped base cap portion 11 and a swivelable closure portion 12 mounted thereon. The dispensing closure is preferably a lightweight construction made of molded plastic. With reference to FIGS. 1–3, the cap portion 11 is formed with a peripheral depending skirt 13 which sealably fits about a bottle neck 14 of a bottle receptacle containing, for example, fluent material. The peripheral skirt has a threaded upper region 15 which cooperates with corresponding threads formed about the bottle mouth opening 16, permitting sealable, removable attachment of the dispenser cap over the bottle mouth. The cap portion 11 is formed with a substantially planar top surface 17 which covers the bottle mouth opening 16.

The cap top surface 17 is formed with a transversely extending recessed wall portion 18 leading radially out through the circumferential edge of the top surface. The interior end of the recessed wall 18 is formed with a generally semicircular depressed socket portion 19 spaced apart from a dispensing orifice 20 extending through the bottom wall of the recess adjacent the leading end thereof. The dispensing orifice 20 freely communicates with the bottle mouth 16 and the contents of the bottle. The socket portion 19 is formed with a planar front sidewall surface 21 and a back sidewall surface 22 leading to the top surface 17.

As illustrated in FIG. 5, an upstanding post portion 23 is formed adjacent the socket front wall. The post portion has a rearwardly facing, upright bulbous end member 24, which extends into the recess of the socket 19. Forwardly of the post 23 is a transverse cross-bar planar surface 25 extending upraised from the bottom of the socket 19. The functions of the post and cross-bar features are described below.

The closure portion 12 is formed with a leading edge lip portion 30 which overhangs the peripheral edge of the recessed wall 18 when the closure portion is in a closed condition as shown in FIG. 2. Spaced inwardly of the lip 30 is a plug or stopper member 31 formed on the undersurface of the closure portion dimensioned to be received in the dispensing orifice 20 in substantially tight-fitting sealing engagement. The inward facing 32 and outward facing 33 edge surfaces of the stopper and dispensing orifice, respectively, are preferably beveled to ease engagement of the stopper 31 into the orifice 20. The rearward end of the closure portion 12 is formed with a downturned flange portion 34.

As illustrated in FIG. 4, the flange 34 is formed with opposed side surfaces 35 and 36 having recesses or depressions 37 and 38 respectively formed therein. Corresponding dimple members 39 and 40 project outward from opposite sidewall portions 41 and 42, respectively, of the socket 19 for fitting within the flange side surface recesses so as to mount the closure portion 12 for pivotal movement relative to the cap top 17 and permit a snap receipt of the flange 34 in the socket 19 to affix the closure portion 12 in the cap 11. The closure portion 12 is pivotal between a first extreme position, as shown in FIG. 2, whereby the closure is substantially horizontally disposed and the stopper 31 is received in the dispensing orifice 20 and a second extreme open position, as shown in FIG. 3, whereby the closure is bent back slightly from a vertical line 50.

The flange 34 defines a downwardly extending back or end wall surface 45 which is movable within the socket cavity 19. Formed generally centrally along the flange back wall 42 is a T-shaped opening 43 dimensioned to receive the upright bulbous end 24 of the post 23 during pivotal movement of the closure portion 12. The opening 43 contains a relatively narrowed throat portion 44 which opens out beneath the flange back wall 45. The throat opening 44 is of a width less than the width of the post bulb 24. When the closure portion 12 is initially pivoted such that the stopper 31 is raised over the recessed wall 18 to approaching 90° from the orifice 20, the bulb end 24 is forced into the throat portion 44 providing a resilient force for pulling or biasing the flange back wall 45 relatively forwardly in the socket 19. This action causes the closure portion 12 to be bent backward over the top surface 17 to an extreme open position pulling the stopper 31 fully out of the flow path through the dispensing orifice 20. The material of at least one of the post 23 and flange 34 is sufficiently yieldable to allow the bulb end 24 to be passed through the throat opening 44 during pivotal movement of the closure portion 12. To remove and mount the closure portion 12 on the cap 11, the closure portion must be vertically positioned such that the opening 43 is aligned with the post end member 24 as shown in FIG. 5.

Operation of the dispensing cap closure 10 is as follows. With the closure portion 12 positioned in a closed condition, shown in FIG. 2, the closure portion 12 is lowered into the cap recess 18 so as to extend in substantially horizontal fashion with the planar upper surface of the closure portion substantially flush with the planar top surface 17 of the cap. In this condition, the stopper 31 is sealably received in the dispensing orifice 20 and, thereby, precludes dispensing of the bottle contents. The leading lip portion 30 of the closure 12 slightly overhangs the periphery of the cap top surface 17, so that the user is free to apply an upward force to the closure portion 12 with a finger for opening.

The closure portion 12 is dislodged from its closed condition in a two-stage movement. The initial movement passes the closure portion 12 to an upraised position approaching the vertical line 50, which represents a plane orthogonal to the top surface 17. This initial movement of the closure portion is brought about by applying a slight upward force against the protruding lip 30 or may be brought about by applying a downward force on the upper surface of the closure adjacent the flange back wall 45 in the direction of the socket recess. Opening may be further facilitated by providing for slight compression of the stopper member 31 as it fits into the dispensing opening 20, so as to arrange for a resilient reaction force to be applied against the stopper surface after the stopper has been raised a predetermined distance within the dispensing orifice. This reaction force may be such that the closure portion 12 pops out of closed condition and snap travels through the first stage of movement. As the closure portion 12 is raised relative to the recessed wall portion 18, the flange 34 rotates within the socket 19 about the projecting dimple members 39 and 40.

As the closure portion 12 approaches the vertical line 50, the bulb end 24 is forced into the throat opening portion 44 and there results a second stage movement whereby the closure portion 12 is pulled to a fully bent back position shown in FIG. 3. In this full open condition, the closure portion 12 will no longer be obstructing discharge flow through he dispensing orifice 20. In the extreme open position, the closure portion 12 lies in a plane approximately 30° beyond the vertical. To prevent the closure portion 12 from being sent back further and, thereby, precluding the closure portion from being snapped out of connection in the socket 19 by being bent back too far away from the dispensing orifice 20, the flange end wall 45 abuts against the planar surface of the cross-bar extension 25. A slanted planar surface 51 is formed along the back wall 22 of the socket 19 to cooperatively receive the upper surface of the closure portion 12 resting thereagainst in this extreme open position. The planar surface 25 and back wall surface 51 serve to a stop surfaces which pin the closure portion 12 in its bent back extreme open condition so that further backward movement is not possible and the closure portion 12 can not be accidentally pivoted out of the socket 19.

Thus, the bulb head 24 and the throat portion 44 are engaging means which provide means for resisting relative movement of the flange 34 and the socket forward wall 21 effective to resist movement from the full open position towards the closed position and in the reverse direction towards the full open position.

Although various minor modifications may be suggested by those versed in the art, it should be understood that I wish to embody within the scope of the patent warranted hereon all such modifications as reasonably and properly come within the scope of my contribution to the art.

I claim as my invention:

1. A dispensing closure for containers comprising a cup-shaped cap portion having a peripheral depending skirt and a top with a dispensing orifice therethrough, a depressed socket portion formed in said top spaced from said orifice, said socket portion having a raised post extending upwardly from a bottom thereof, a pivotal closure for said orifice, said closure having a stopper formed on an undersurface thereof dimensioned to be received in said orifice in substantially sealing engagement therewith and a depending flange spaced from said stopper forming an end wall for said closure, said flange having an opening therethrough dimensioned to receive said post, said opening having a throat opening thereto at a bottom of the flange, said throat opening having a dimension less than the opening and less than a dimension of the post, said flange being receivable in said socket whereby when said closure is assembled to said cap with said flange in said socket, upon pivoting the closure from a first position with the stopper in the orifice to a second position with the stopper lying above the top of the cup-shaped portion, the flange will pivot in the socket with the post being forced into the throat opening to the flange opening to lock the closure in the pivoted open second position.

2. The device of claim 1, wherein the material of at least one of the post and flange is yieldable to allow the larger post to be forced through the smaller throat opening.

3. The device of claim 2, wherein the closure is formed with sidewall portions adjacent the flange, the socket being formed with sidewall portions on opposite sides thereof, the sidewall portions of the socket having projecting dimples formed therein, the sidewall portions of the closure adjacent the flange having recesses formed therein for snap receipt of the dimples to affix the closure to the cup-shaped cap portion.

4. The device of claim 3, wherein the post is formed with a bulbous end extending from a front wall of the socket closest to the dispensing orifice.

5. The device of claim 4, wherein the front wall of the socket has a planar surface for engaging a bottom surface of the flange limiting pivoting of the closure in the socket, whereby the closure cannot be snapped out of the socket by back bending the closure away from the dispensing orifice.

6. The device of claim 5, wherein back bending of the closure is limited to no more than approximately 30° beyond the vertical.

7. The device of claim 5, wherein an upraised cross-bar surface extends over the socket planar surface.

8. The device of claim 1, wherein the stopper is dimensioned for a compressed, force fit into the dispensing orifice.

9. The device of the claim 8, wherein the cap and closure are made of relatively lightweight, plastic material.

10. The device of claim 1, wherein said peripheral skirt is formed with an interior facing threaded portion.

11. A lightweight plastic dispensing closure comprising a cap portion having a top surface for attaching over a container opening, a recessed wall portion formed in said top surface including a dispensing orifice extending therethrough and a depressed socket portion spaced inward of said orifice, a closure member having a stopper formed on an undersurface thereof dimensioned for a compressible force fit receipt in said orifice and a downturned flange portion mounted for pivotal movement in said socket portion, and a stationary planar surface along said socket portion for engaging with said flange portion to limit upraised pivotal movement of said closure to a full open position slightly beyond the vertical and interengaging means projecting from a forward wall portion of said socket portion and on said flange portion including means for resisting relative movement of the closure member and socket portion both from the full open position towards a closed position and a reverse movement towards the full open position from a position intermediate the full open position and closed position.

12. The device of claim 11, wherein an upraised cross-bar surface extends from said planar surface.

13. The device of claim 11, wherein said planar surface limits bending back of said closure to no more than approximately 30° beyond the vertical.

14. The device of claim 11, wherein said closure has a lip surface, spaced outward from said stopper and which protrudes over the corresponding peripheral profile of said top surface when said stopper is in said orifice, for receiving a relatively light upward force which pops said stopper from said orifice and pivots said closure to a position upraised from said recessed wall.

15. The device of claim 11, wherein said socket portion contains a raised post, said flange portion having an opening therethrough to receive said post during upraised pivotal movement of said closure, said opening having a relatively narrowed throat opening portion having a dimension less than a dimension of said post, whereby, upon pivoting said closure from a substantially horizontal closed position with said stopper in said orifice to a substantially upright open position with said stopper raised over said recessed wall, said post if forced into said throat opening to bias said closure into a fully open position bent back from the vertical.

16. The device of claim 15, wherein said post is formed with a bulbous end which is of a larger width than that of said throat opening portion.

17. The device of claim 15, wherein said socket portion is formed with sidewall portions on opposite sides thereof, said sidewall portions having corresponding projecting dimples formed thereon, said closure having opposed side surfaces adjacent aid flange portion, said side surfaces having recesses formed therein for snap receipt of said dimples to mount said closure in said socket portion.

18. The closure of claim 15 wherein the engaging means includes means preventing rotation of the closure beyond the second position.

19. The closure of claim 15 wherein the engaging means comprises a bulbous ended post projecting from the forward wall rearwardly into the socket, an opposed opening in the flange extending into the flange from a free end of the flange aligned with the post, the opening having a throat opening section and an enlarged base section, the throat opening section having a dimension less than the bulbous end of the post and at least one of the post and flange being resilient whereby the bulbous head of the post can be forced through the throat opening to the base section of the opening.

20. A dispensing closure comprising a cap portion having a top surface, a socket portion recessed in said top, a dispensing opening through said top spaced from the socket, said socket having a forward wall portion and side wall portions, a closure member having a rear depending flange and a depending stopper spaced from the flange for closing the opening, a pivot connection between the closure member and cap, the closure member movable about the connection from a first position with the stoppr closing the opening to a second position with the stopper elevated above the top surface, the closure member rotating in excess of 90° rotation from the first position to the second position, the flange moving within the socket during the said rotation, and opposed engaging means on the socket forward wall portion and closure member flange including means for resisting relative movement of the opposed engaging means, said latter means engaged by rotational movement of the flange from the first position towards the second position for retaining the closure member in the second position, and further effective to resist movement from the second position towards the first position, the engaging means on the socket forward wall being stationary.

* * * * *